US010217449B1

(12) United States Patent
Gearhart et al.

(10) Patent No.: US 10,217,449 B1
(45) Date of Patent: Feb. 26, 2019

(54) PERCUSSIVE BEATER WITH TRANSDUCER

(71) Applicant: Matt & Kim Inc., New York, NY (US)

(72) Inventors: Andrew Robert Gearhart, Brooklyn, NY (US); Douglas Marshall Johnson, Souderton, PA (US)

(73) Assignee: Matt & Kim Inc., New York, NY (US)

( * ) Notice: Subject to any disclaimer, the term of this patent is extended or adjusted under 35 U.S.C. 154(b) by 0 days.

(21) Appl. No.: 15/912,167

(22) Filed: Mar. 5, 2018

(51) Int. Cl.
*G10H 3/14* (2006.01)
*G10D 13/00* (2006.01)
*G10H 1/32* (2006.01)

(52) U.S. Cl.
CPC ..... *G10H 3/146* (2013.01); *G10D 13/006* (2013.01); *G10H 1/32* (2013.01); *G10H 3/143* (2013.01); *G10H 2220/185* (2013.01)

(58) Field of Classification Search
CPC ..... G10H 3/146; G10H 1/32; G10H 3/143; G10H 2220/185; G10D 13/006
USPC ..... 84/730
See application file for complete search history.

(56) References Cited

U.S. PATENT DOCUMENTS

| | | | |
|---|---|---|---|
| 7,282,633 | B1 | 10/2007 | Coolidge |
| 8,170,258 | B1 | 5/2012 | Wells |
| 9,124,967 | B2 | 9/2015 | Morton |
| 2010/0031806 | A1 | 2/2010 | Gaynier |

OTHER PUBLICATIONS

Photographs of 2014 drum beaters, assembled by Andrew Gearhart, Matt & Kim Inc.

*Primary Examiner* — Jeffrey Donels
(74) *Attorney, Agent, or Firm* — Proskauer Rose LLP

(57) ABSTRACT

A percussive beater includes an elongated shaft having a first end and a second end; a beater head mechanically coupled to the first end of the elongated shaft; and a transducer mechanically coupled to the beater head, the transducer configured to receive an impact from the beater head and convert the impact into an electrical signal. The percussive beater also includes, in various embodiments, one or more of: an electrical signal filter in electronic communication with the transducer, the electrical signal filter configured to receive the electrical signal, adjust a portion of the electrical signal, and output an adjusted electrical signal; a transducer that is located inside the beater head along with one or more of a wireless connector, an electrical connector or an electrical wire; or a front face that is in direct contact with a padding layer, the padding layer in direct contact with the transducer.

21 Claims, 6 Drawing Sheets

PERCUSSIVE BEATER WITH TRANSDUCER

FIELD OF THE INVENTION

The invention relates generally to musical drum beaters and associated sound amplification devices and methods. More specifically, the invention relates to an enhanced kick drum beater incorporating a mechanically coupled transducer and other improvements.

BACKGROUND

A typical drum set includes a kick drum, which is a large bass drum that produces a low-pitched sound. The kick drum is typically cylindrical and has a diameter that is larger than its depth. Kick drums are often too large to be handheld and are therefore mounted in some way, for example on a floor stand. Using such a setup, to play the kick drum, one or more kick drum beaters are provided to hit the drum head. For example, during a concert or practice session, a typical arrangement is to mount the drum beater on a foot pedal, which a drummer can use to actuate the drum beater toward the kick drum and strike the kick drum. This arrangement leaves the drummer's hands free to play any number of other drums and cymbals simultaneously, thereby producing a fuller and richer drum chorus.

Traditionally, microphones are responsible for picking up kick drum sounds using sensed vibrations of the drum head itself. One such system is described in U.S. Pat. No. 9,124,967 to Morton, titled "Microphone systems for base drums and other instruments." In this device, a microphone system and microphone mount system are integrated directly into a drum head to capture drum sounds. Another example is described in U.S. Pat. No. 7,282,633 to Coolidge, titled "Sound Augmentation System and Method for a Drum." In this device, a sound augmentation system for a drum includes a wave generator for producing an electrical signal, an amplifier for amplifying the electrical signal, and a driver for translating the amplified electrical signal to a plurality of sound waves. In operation, a strike of the drum head produces amplified sound waves that emanate from the body of the drum.

One problem with such traditional devices is that they are susceptible to many false triggers, particularly in environments with ambient noise and/or active musicians. For example, if a musician performs stunts on stage and contacts or influences the drum, directly or indirectly (such as by moving it or standing on it) unwanted drum sounds can be inadvertently triggered during concert. In addition, large speakers on stage can vibrate drum heads, causing a false trigger. Moreover, when switching drums in the drum setup, settings have to be adjusted, which can cause a problem if many different drums are used or if a drum breaks during a show and needs to be replaced. What is needed is a solution that accurately senses signals indicating that the kick drum has been hit, thereby reducing or eliminating false triggers, and is robust enough to endure harsh tour conditions and exuberance on stage.

SUMMARY OF THE INVENTION

A drum beater having an attached microphone was previously used repeatedly (e.g., tested) live in concert. In the present invention, multiple improvements are made over that device.

In one illustrative embodiment, a drum beater is mounted on top of a kick drum pedal and used to hit a kick drum. After the kick drum is hit, the impact or sound created by the hitting (e.g., variations in air pressure emanating off of the kick drum head) is sensed by a transducer (e.g., a piezo pickup microphone) that is built directly into (e.g., included within a head of) the drum beater itself. The transducer, in combination with other electronic components, can be configured to convert the impact or sound into an electrical signal and send the electrical signal to an electronic device (e.g., a trigger module) that is programmed to sense a transient or "sharp attack" sound or signal. When such a sound or signal is sensed, a predetermined sound file (e.g., corresponding to a drum sound) can be played (e.g., by an audio playback device in electrical communication with the electronic device). The drum beater can function in a variety of settings, such as live performance and studio recording.

One advantage of the invention is to provide more reliable, high quality sound associated with beating of a kick drum. Another advantage is that the invention allows for more accurate drum triggering, as it is percussive and not measured by vibration. In other words, it does not need to rely on a drum head to send trigger messages—it can be independent of the drum head. Another advantage of the invention is that the drum beater can attach to a wide variety of items besides drums, and can be used to hit a wide variety of objects that an inventive musician may use as a drum. In this sense, the word "drum" can be understood broadly to include anything capable of being struck for the purpose of producing a sound upon being struck. In fact, while the word "drum beater" is used throughout for illustration purposes, the drum beaters shown and described may be referred to broadly as "percussive beaters." Another advantage of the invention is that the sound sensing component does not fall off the kick drum as easily as in past designs and is sturdier than past configurations have been. Another advantage is that the invention eliminates the need for an additional piece of hardware that attaches to the kick drum itself, such as those found in the prior art.

In one aspect, the invention features a percussive beater (e.g., drum beater). The percussive beater includes an elongated shaft having a first end and a second end. The percussive beater also includes a beater head mechanically coupled to (e.g., substantially enclosing) the first end of the elongated shaft, the beater head including a front face. The percussive beater also includes a transducer mechanically coupled to the beater head, the transducer configured to receive an impact from the beater head and convert the impact into an electrical signal. The percussive beater also includes an electrical signal filter in electronic communication with the transducer, the electrical signal filter configured to (i) receive the electrical signal, (ii) adjust (e.g., remove or flatten) a portion of the electrical signal, and (iii) output an adjusted electrical signal.

In some embodiments, the electrical signal filter is a clipper circuit that removes any (or substantially any) portion of the electrical signal that is below predetermined voltage. In some embodiments, the predetermined voltage is between 1 and 5 Volts, for example 2.5 Volts. In some embodiments, the predetermined voltage is adjustable by a user via a knob, dial, slider, or other use-adjustable interface. In some embodiments, the electrical signal filter removes any portion of the electrical signal outside of a certain frequency band. In some embodiments, the frequency band is between 800 MHz and 8.0 KHz, or in some cases falls within a more narrow range, such as between 6.4 and 7.6 KHz. In some embodiments, the percussive beater includes an electrical cable coupled to the elongated shaft, the electrical cable in electrical communication with the transducer and configured to transport the adjusted electrical signal. In some embodiments, the electrical cable is received by an audio jack included within the beater head, the audio jack in electrical communication with the electrical signal filter. In some embodiments, the percussive beater includes a wireless module such as a Bluetooth module, the wireless module configured to transport the adjusted electrical signal. In some embodiments, the percussive beater includes a locking feature configured to (i) allow the cable to detach from the beater head upon application of a detaching force and (ii) prevent the cable from detaching from the beater head inadvertently.

In some embodiments, the percussive beater includes a wireless signal transmitter in electronic communication with the signal filter, the wireless signal transmitter configured to receive the adjusted electrical signal and to transmit the adjusted electrical signal to a signal receiver. In some embodiments, the wireless signal transmitter is included in a module with the electrical signal filter and a battery. In some embodiments, the percussive beater includes a padding layer in mechanical communication with the front face of the beater head. In some embodiments, the transducer is located inside of the beater head. In some embodiments, the padding layer is made of a foam material. In some embodiments, the padding layer includes expanded polyethylene. In some embodiments, the transducer is included in a bore of the beater head. In some embodiments, the second end of the percussive beater is configured to be coupled to a foot pedal apparatus for use with a kick drum.

In another aspect, the invention features another percussive beater. The percussive beater includes an elongated shaft having a first end and a second end. The percussive beater also includes a beater head mechanically coupled to the first end of the elongated shaft, the beater head including a front face. The percussive beater also includes a transducer mechanically coupled to the beater head, the transducer configured to receive an impact from the beater head and convert the impact into an electrical signal. The transducer and at least one of a wireless connector, an electrical connector or electrical wire are located inside the beater head. In another aspect, the invention features another percussive beater. The percussive beater includes an elongated shaft having a first end and a second end. The percussive beater also includes a beater head mechanically coupled to the first end of the elongated shaft, the beater head including a front face. The percussive beater also includes a transducer mechanically coupled to the beater head, the transducer configured to receive an impact from the beater head and convert the impact into an electrical signal. The front face is in direct contact with a padding layer and the transducer is in direct contact with the padding layer. In some embodiments, the padding layer includes a foam material, e.g., expanded polyethylene.

In another aspect, the invention features a system for providing percussion (e.g., drum) sounds. The system includes a percussive beater. The percussive beater has an elongated shaft having a first end and a second end; a beater head mechanically coupled to the first end of the elongated shaft, the beater head including a front face; a transducer mechanically coupled to the beater head, the transducer configured to receive an impact from the beater head and convert the impact into an electrical signal; and an electrical signal filter in electronic communication with the transducer, the electrical signal filter configured to (i) receive the electrical signal, (ii) adjust (e.g., remove or flatten) a portion of the electrical signal, and (iii) output an adjusted electrical signal. The system also includes an electronic device (e.g., a trigger module) in electronic communication with the percussive beater, the electronic device configured to process the adjusted electrical signal provided by the percussive beater and produce an output signal. The system also includes an audio playback device in electronic communication with the electronic device, the audio playback device configured to play a predetermined sound (e.g., a locally stored sound file) upon receiving the output signal from the electronic device.

In another aspect, the invention features a method of providing a drum sound. The method includes receiving, by an electronic device (e.g., a trigger module), an electrical signal provided by a percussive beater in accordance with, for example, one of the percussive beaters described above. The method also includes processing, by the electronic device, the electrical signal provided by the percussive beater, thereby producing an output signal. The method also includes providing, by the electronic device, the output signal to an audio playback device.

In some embodiments, the "trigger" is considered to be the electronic part of the beater head (e.g. includes a transducer, an audio jack, and/or a signal filter). In some embodiments, a cable is coupled to the elongated shaft and is in electrical communication with the transducer. In some embodiments, the cable is detachable from the transducer and/or includes a locking feature configured to prevent the cable from detaching from the transducer inadvertently. In some embodiments, a detachable cable is advantageous because it decreases the likelihood of breaking the percussive beater and needing to replace the whole percussive beater, as opposed to just the cable. In some embodiments, the locking feature is a locking collar within the beater head to lock the cable and prevent it from becoming disconnected unintentionally. In some embodiments, a cable holder is added so that the cable does not get in the way of the drummer's foot while the drummer is playing the kick drum.

In some embodiments, the transducer is located inside a bore of the beater head. In some embodiments, a piezo pickup microphone is included in the beater head as the transducer. In some embodiments, the front face of the percussive beater includes a rubber material, which may allow the trigger to last longer than, for example, wood, felt or plastic. In some embodiments, a rubber pad is located on and forms an exterior surface of the beater head, e.g., to increase accuracy during playing. In some embodiments, the transducer is not located directly behind the front face of the beater, but is located behind a padding layer (e.g., a piece of soft but rigid foam) that intervenes between it and the front face of the beater. In some embodiments, the padding layer is used to dampen the impact received by a front face of the percussive beater (e.g., a face is made of rubber, and right behind the rubber is the padding layer, e.g. a foam layer, to prevent the impact to the transducer from being too intense). In some embodiments, the padding layer protects the transducer and/or increases the lifespan of the device. In some embodiments, the cable includes a clip to attach the cable to the shaft of the percussive beater, stabilizing the cable and keeping it out of the way of the user. In some embodiments, the trigger includes a clipper circuit to remove a portion of the received electrical signal below a certain predetermined threshold voltage. In some embodiments, a Bluetooth module, a filter and a battery are included in the same physical module to save space within the percussive beater.

BRIEF DESCRIPTION OF THE DRAWINGS

The foregoing discussion will be understood more readily from the following detailed description of the invention when taken in conjunction with the accompanying drawings.

DETAILED DESCRIPTION OF THE DRAWINGS

Figure 1A:
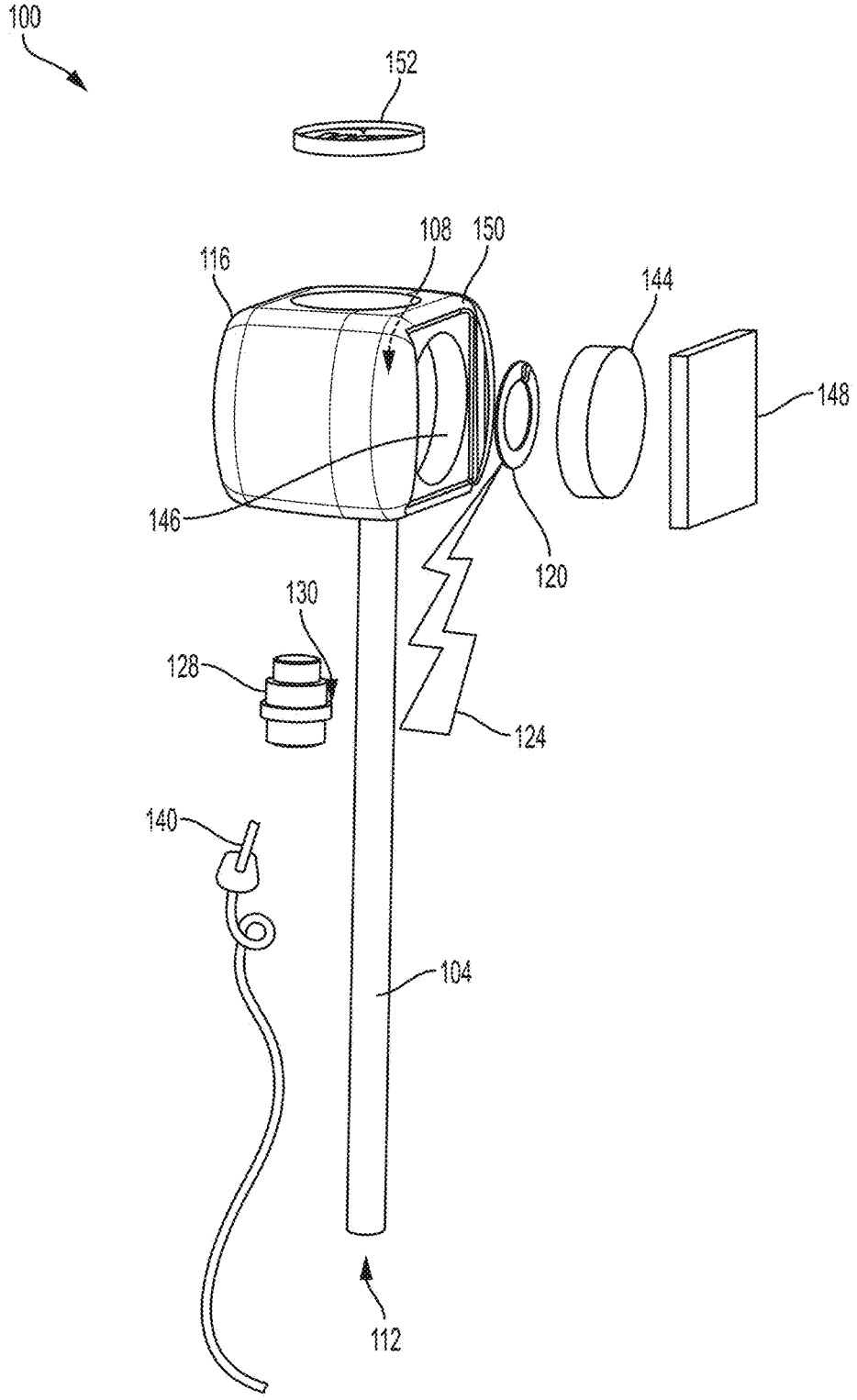
FIG. 1A is an exploded view of an exemplary drum beater, according to an illustrative embodiment of the invention.
Figure 1B:
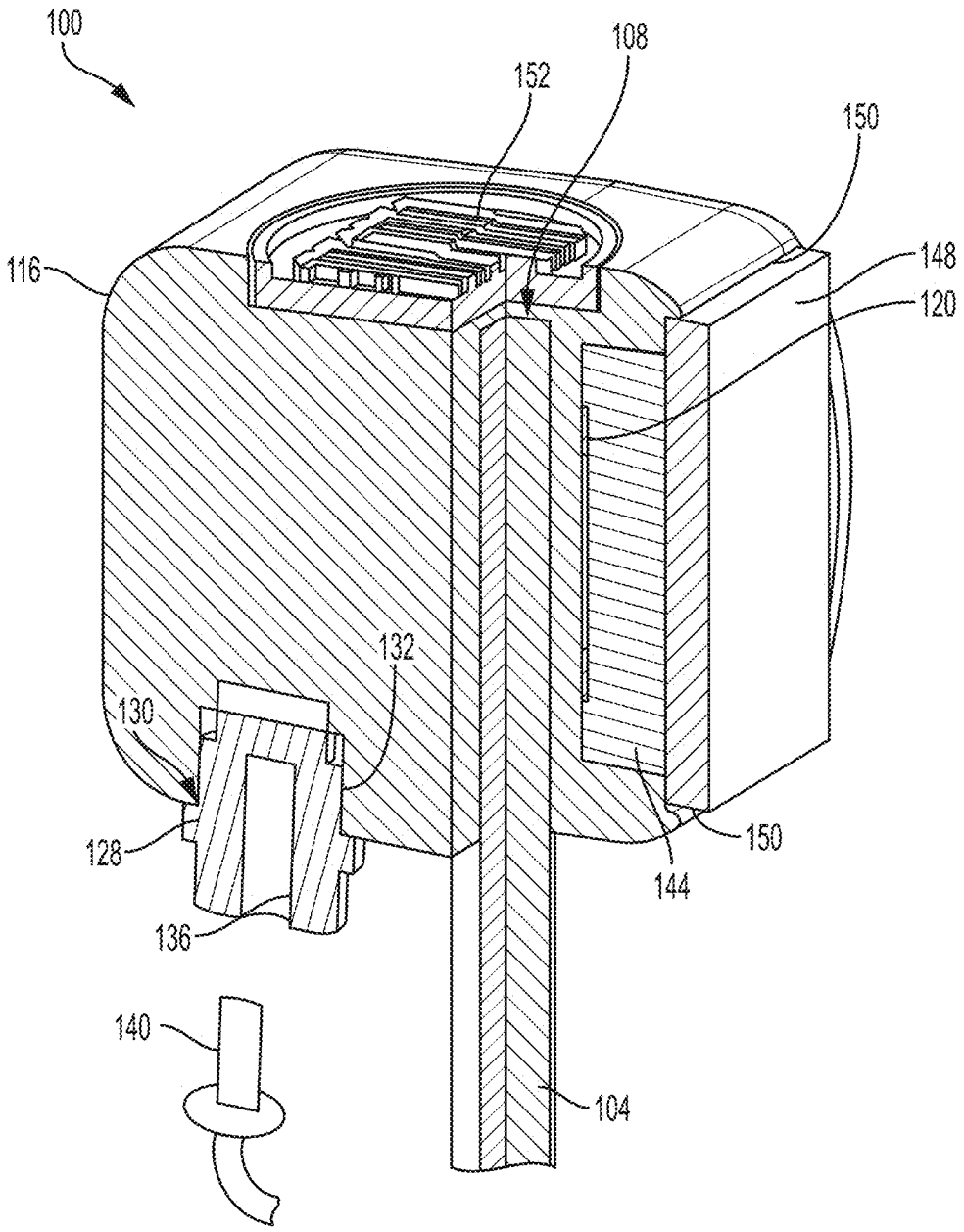
FIG. 1B is a sectional view of the drum beater of FIG. 1A according to an illustrative embodiment of the invention.
Figure 1C:
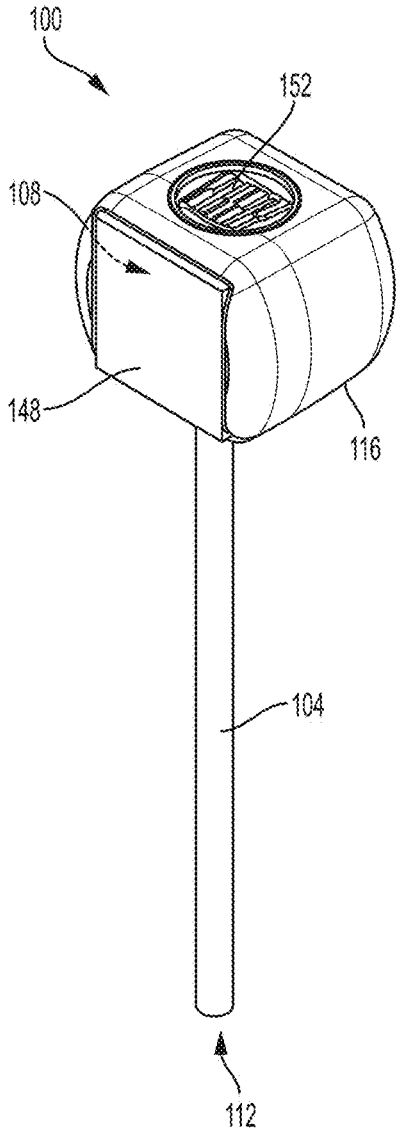
FIG. 1C is an isometric view of the drum beater of FIG. 1A according to an illustrative embodiment of the invention.
Figure 1D:
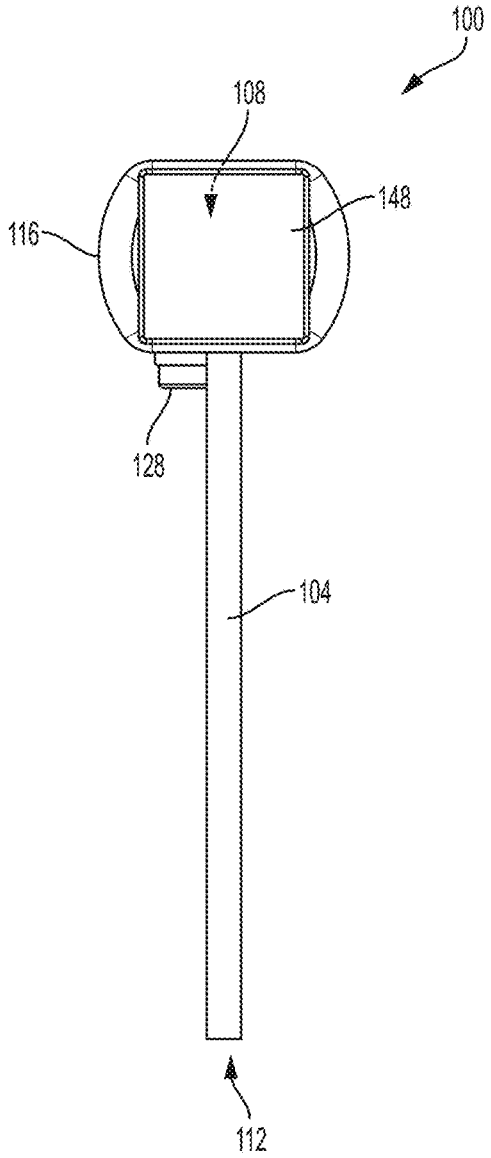
FIG. 1D is a front view of the drum beater of FIG. 1A according to an illustrative embodiment of the invention.

FIGS. 1A-1E show various views of an exemplary drum beater (or percussive beater) 100 according to an illustrative embodiment of the invention. These views include an exploded view (FIG. 1A), a sectional view (FIG. 1B), an isometric view (FIG. 1C), a front view (FIG. 1D) and a rear view (FIG. 1E) of the drum beater 100. As depicted, the drum beater 100 includes an elongated shaft 104 having a first end 108 and a second end 112. The drum beater 100 also includes a beater head 116 that is mechanically coupled to (e.g., fixed to by molding and/or substantially enclosing) the first end 108 of the elongated shaft 104. The drum beater 100 also includes a transducer 120 that is mechanically coupled to the beater head 116. The transducer 120 is configured to receive an impact or sound waves from the beater head 116 and to convert the impact or sound waves into an electrical signal 124.

The drum beater 100 also includes an audio jack 128 that is electrically connected (e.g., through a signal and ground wire) to the transducer 120 and is configured to receive the electrical signal 124. The audio jack 128 can fit snugly into a bore 132 of the beater head 116 configured to receive the audio jack 128. In some embodiments, the audio jack 128 has a feature 130 that aids alignment of the audio jack 128 within the bore 132 and limits the depth to which the audio jack 128 is taken into the bore 132. The audio jack 128 can itself have a bore 136 that is configured to receive a locking cable 140. In some embodiments, the locking cable 140 can include a length of wire that can be secured (e.g., clipped) to the elongated shaft 104.

In some embodiments, the drum beater 100 includes a padding layer (e.g., a foam layer, for example made of expanded polyethylene or a similar material) 144 that can protect the transducer 120 and can expand the lifespan of the drum beater 100. The padding layer 144 fits into a second bore 146 in the beater head 116, the second bore 146 shaped to receive the padding layer 144 snugly. The transducer 120 can fit snugly between the padding layer 144 and the interior of the beater head 116. In some embodiments, the drum beater 100 includes a front face 148 (e.g., for beating the drum) located on and forming an exterior surface of the beater head 116. The front face 148 can have, for example, a rounded or a square shape, and can be made of rubber, foam, felt or wood, among other materials. In some embodiments, the beater head 116 includes a feature 150 (e.g., one or more lips or snap features) to contain the front face 148 snugly within the beater head 116. The padding layer 144 can be located behind the front face 148. The padding layer 144 can also be in direct or indirect physical contact with the front face 148. In some embodiments, the drum beater 100 includes an insert 152 that can function as a branding device, such as a plastic plate having a logo or design. In some embodiments, the drum beater 100 includes a rear face 156 opposite the front face 148.

In some embodiments, the transducer 120 is an electroacoustic transducer such as a piezo microphone having a circular perimeter. The transducer 120 can receive an impact or sound waves via the front face 148 when the drum beater 100 is struck against a drum and convert the impact or sound waves into an electrical signal 124, which can be provided to the cable 140 (e.g., directly or indirectly). In some embodiments, the electrical signal 124 travels through the cable 140 onto an electronic component to which the cable 140 is connected (e.g., a trigger module as shown and described below in FIG. 3 or directly onto an audio playback device). In some embodiments, the transducer 120 is configured to produce an electrical signal only when it receives a sound wave in a certain specified range, e.g., in the range of 800 MHz to 8 KHz or 6.4 KHz to 7.6 KHz. In some embodiments, the cable 140 is detachable from the audio jack 128. In some embodiments, the cable 140 includes a locking feature (e.g., a thread that is screwed into the audio jack 128). In some embodiments, the drum beater 100 further includes a cable holder that restricts the cable movement. In some embodiments, the front face 148 of the beater head shields the transducer 120, in combination with the padding layer 144, to limit damage to the transducer 120 upon impact. In some embodiments, the transducer 120 is configured to produce an electrical signal when it receives a single voltage peak.

Figure 2A:
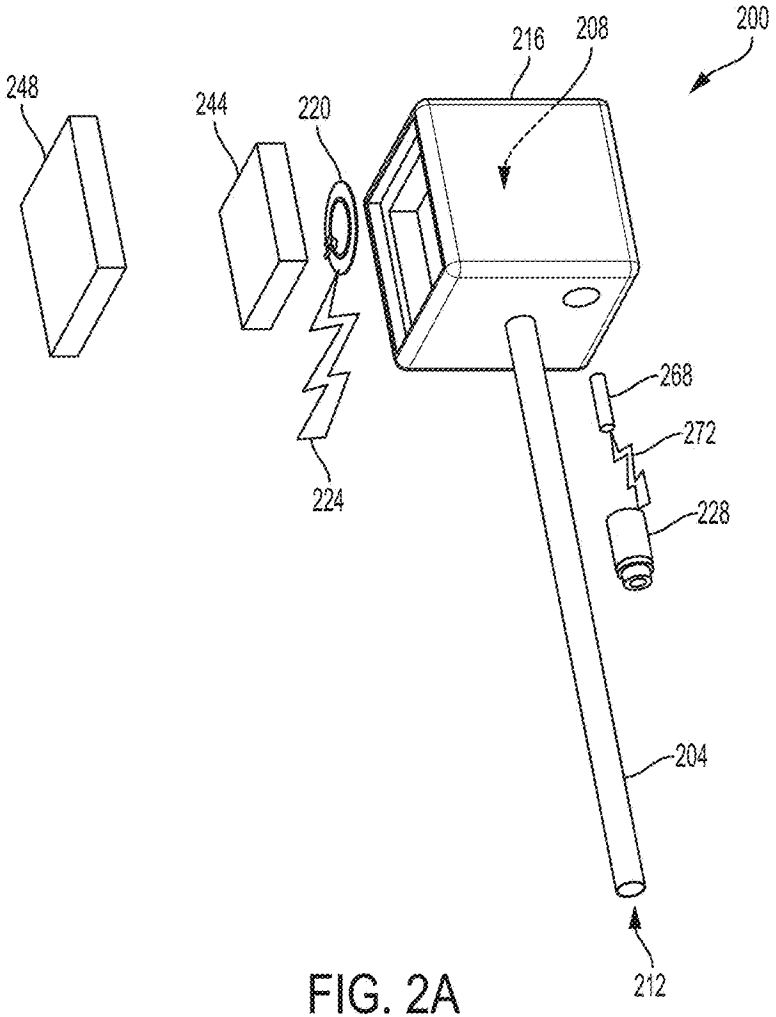
FIG. 2A is an exploded view of another exemplary drum beater, according to an illustrative embodiment of the invention.
Figure 1E:
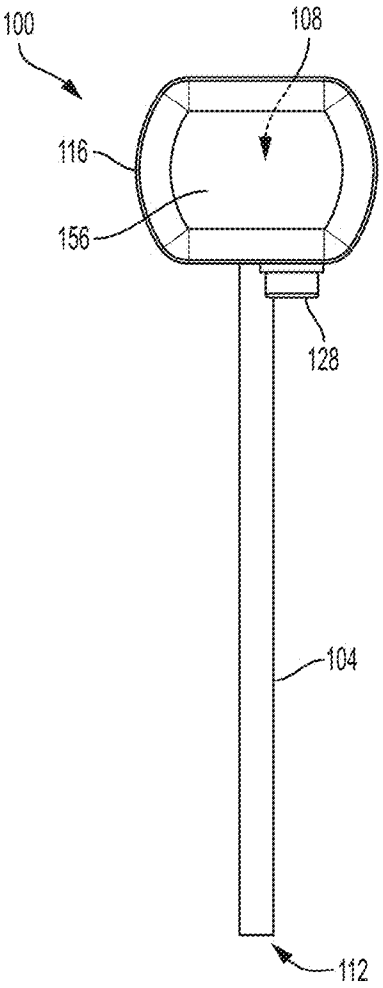
FIG. 1E is a rear view of the drum beater of FIG. 1A according to an illustrative embodiment of the invention.

FIG. 2A is an exploded view of another drum beater 200, according to an illustrative embodiment of the invention. The drum beater 200 can include similar elements to those shown and described above in FIGS. 1A-1E, for example, an elongated shaft 204 having a first end 208 and a second end 212 opposite the first end 208, a beater head 216 mechanically coupled to the elongated shaft 204, a transducer 220 for producing an electrical signal 224, an audio jack 228, a padding layer 244, and a front face 248. These elements can be interrelated in similar ways and perform similar functions to those shown and described in connection with FIGS. 1A-1E. In addition, the drum beater 200 as depicted also differs in certain respects from the drum beater 100 shown and described in FIG. 1. One of ordinary skill in the art will readily appreciate that one or more features of each of these drum beaters 100, 200 can be included in various combinations not explicitly shown in this document.

For example, the drum beater 200 can include a filter 268 (e.g., an electrical signal filter in electronic communication with the transducer 220). The electrical signal filter 268 can be configured to (i) receive the electrical signal 224, (ii) remove a portion of the electrical signal, and (iii) output an adjusted electrical signal 272 (e.g., to a cable as described above or to a wireless module such as a Bluetooth module). In some embodiments, the electrical signal filter 268 is a clipper circuit that removes any portion of the electrical signal that is below predetermined voltage, e.g., a voltage in the range of 1 to 5 Volts, such as 2.5 Volts. In some embodiments, the predetermined voltage is user-adjustable (e.g., by adjusting a voltage knob or other user-adjustable setting). In some embodiments, the electrical signal filter 268 removes any portion of the electrical signal outside 224 of a certain frequency band, e.g., anything outside of the band between 800 MHz and 8.0 KHz (or a more narrow band such as the band between 6.4 KHz and 7.6 KHz), or another band that is focused on the frequencies typically outputted by the device of interest (e.g., a kick drum or another drum). In some embodiments, the electrical signal filter 268 and the audio jack 228 are included in a single, unitary module that also contains a wireless module (e.g., a Bluetooth device) and/or a battery.

Figure 2B:
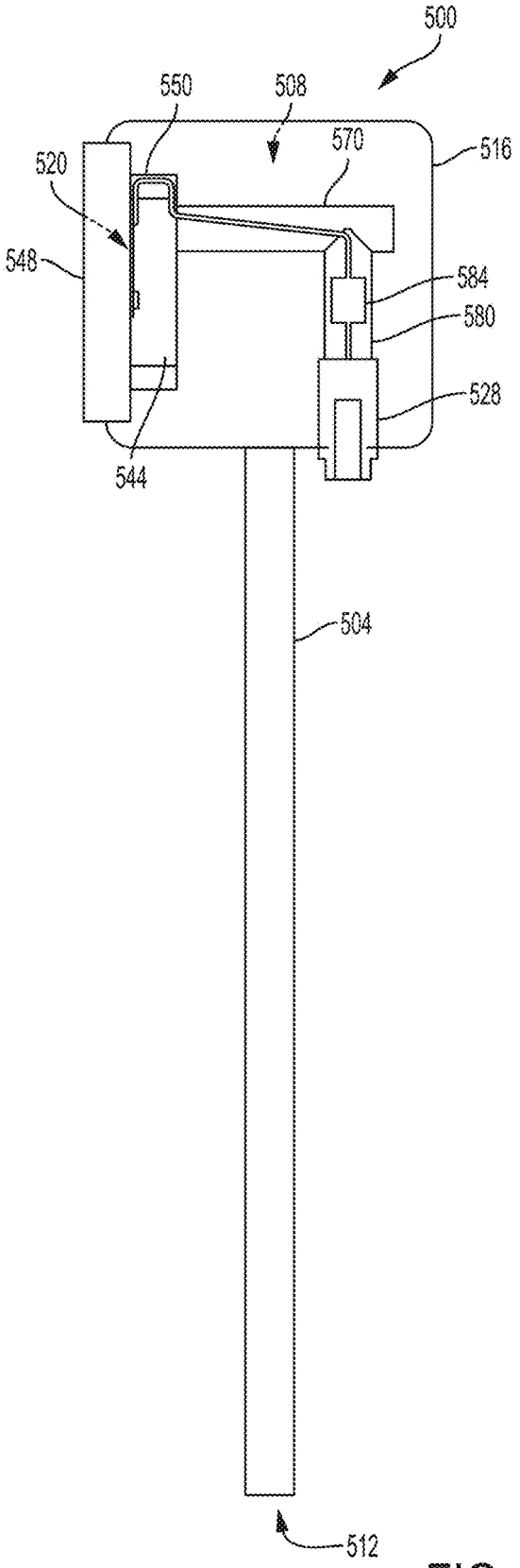
FIG. 2B is a cross-sectional view of another exemplary drum beater, according to an illustrative embodiment of the invention.

FIG. 2B shows a cross-sectional view of another drum beater 500, according to an illustrative embodiment of the invention. The drum beater 500 includes an elongated shaft 504 having a first end 508 and a second end 512 opposite the first end 508. The drum beater 500 also includes a beater head 516 that is mechanically coupled to the first end 508 of the elongated shaft 504. The drum beater 500 can include similar components to those depicted and described above, including a transducer 520, an audio jack 528, a padding layer 544, and a front face 548. In addition, some differences and/or additional features are visible in this cross-sectional view. For example, in the drum beater 500, a wire 550 electrically connects the transducer 520 to the audio jack 528. The wire 550 spans a first internal bore 570 of the beater head 516 and folds (e.g., in a near-90-degree turn) into a second internal bore 580. In some embodiments, the first and second internal bores 570, 580 exist to accommodate the wire 550, which transports electrical current within the wire 550 from the transducer 520 to the audio jack 528. In some embodiments, an electrical signal filter 584 is interspersed in the wire 550 and performs a function similar to the electrical signal filter 268 shown and described above, which can include conditioning and/or clipping of the signal produced by the transducer 520. In this embodiment, the transducer 520 is located between the padding layer 544 and the front face 548, which is another possible arrangement for these components.

Figure 3:
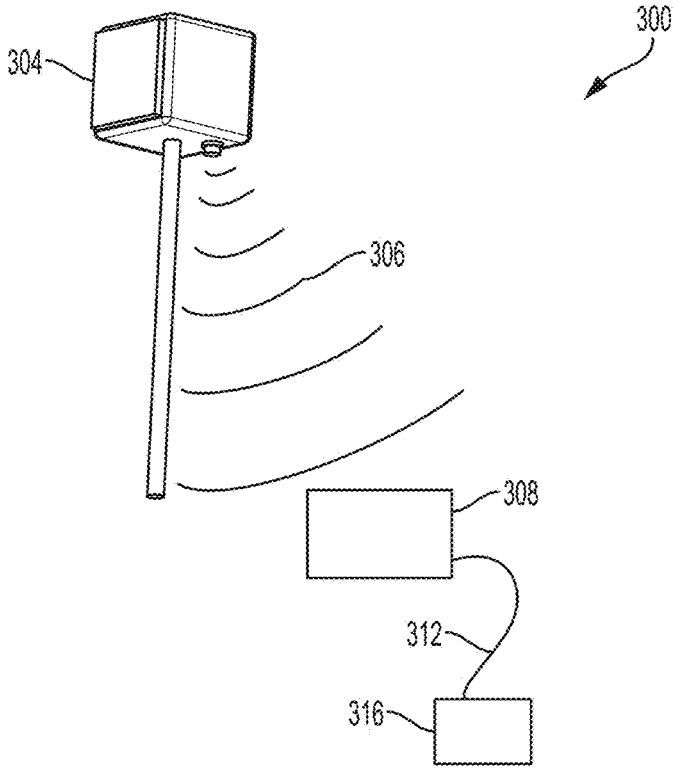
FIG. 3 is a schematic diagram of a system for providing drum sounds according to an illustrative embodiment of the invention.

FIG. 3 is a schematic diagram of a system 300 for providing drum sounds according to an illustrative embodiment of the invention. The system 300 includes a drum beater 304, a trigger module 308 (e.g., a Roland TM2), and a sound playback device 316 (e.g., a laptop, an audio mixing board or audio interface, a pair of headphones, a live speaker in concert, a drum machine, a sample player, or any other device capable of receiving and playing an audio signal) via an electrical wire 312. As depicted, the drum beater 304 communicates with the trigger module 308 using a wireless signal 306 (e.g., a Bluetooth module), although hardwired or other configurations are possible as well. Similarly, although the trigger module 308 communicates with the sound playback device 316 via wire 312, a wireless connection or other electronic communication configuration known in the art may be used instead. In some embodiments, the drum beater 304 can be connected electronically (e.g., wirelessly or via hardwire) to the sound playback device 316 directly.

Figure 4:
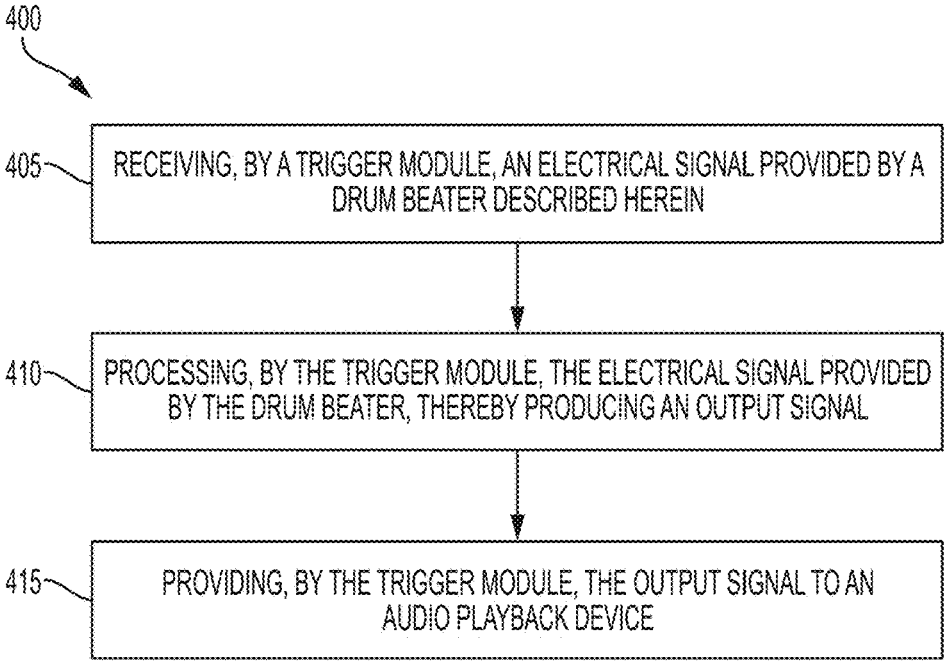
FIG. 4 is a flow diagram of a method of providing a kick drum sound according to an illustrative embodiment of the invention.

FIG. 4 is a flow diagram of a method 400 of providing a kick drum sound according to an illustrative embodiment of the invention. In a first step 405, a trigger module (e.g., the trigger module 308 shown and described above in FIG. 3) receives an electrical signal provided by a drum beater (e.g., the drum beater 300 shown and described above in connection with FIG. 3). In a second step 410, the trigger module processes the electrical signal provided by the drum beater and creates an output signal based upon the incoming electrical signal. In some embodiments, the output signal is a MIDI signal or an audio file corresponding to a drum sound. In a third step 415, the trigger module provides the output signal to an audio playback device (e.g., the audio playback device 316 shown and described above in connection with FIG. 3). In some embodiments, the output signal corresponds to an indication to play any audio file based on the incoming signal.

While the invention has been particularly shown and described with reference to specific preferred embodiments, it should be understood by those skilled in the art that various changes in form and detail may be made therein without departing from the spirit and scope of the invention as defined by the following claims.

What is claimed is:

1. A percussive beater comprising:

an elongated shaft having a first end and a second end;

a beater head mechanically coupled to the first end of the elongated shaft, the beater head including a front face located on and forming an exterior surface of the beater head, the exterior surface of the beater head for beating a drum;

a transducer mechanically coupled to the beater head, the transducer configured to receive an impact from the beater head and convert the impact into an electrical signal;

a padding layer in mechanical communication with the transducer such that either (i) the padding layer is located between an interior surface of the front face and the transducer, or (ii) the transducer is located between the interior surface of the front face and the padding layer; and an electrical signal filter in electronic communication with the transducer, the electrical signal filter configured to (i) receive the electrical signal, (ii) adjust a portion of the electrical signal, and (iii) output an adjusted electrical signal.

2. The percussive beater of claim 1 wherein the electrical signal filter is a clipper circuit that removes a portion of the electrical signal that is below predetermined voltage.

3. The percussive beater of claim 2 wherein the predetermined voltage is between 1 and 5 Volts.

4. The percussive beater of claim 1 wherein the electrical signal filter removes a portion of the electrical signal outside of a certain frequency band.

5. The percussive beater of claim 4 wherein the frequency band is between 800 MHz and KHz.

6. The percussive beater of claim 1 further comprising an electrical cable coupled to the elongated shaft, the electrical cable in electrical communication with the transducer and configured to transport the adjusted electrical signal.

7. The percussive beater of claim 6 wherein the electrical cable is received by an audio jack included within the beater head, the audio jack in electrical communication with the electrical signal filter.

8. The percussive beater of claim 6 wherein the cable includes a locking feature configured to (i) allow the cable to detach from the beater head upon application of a detaching force and (ii) prevent the cable from detaching from the beater head inadvertently.

9. The percussive beater of claim 1 further comprising a wireless signal transmitter in electronic communication with the electrical signal filter, the wireless signal transmitter configured to receive the adjusted electrical signal and to transmit the adjusted electrical signal to a signal receiver.

10. The percussive beater of claim 9 wherein the wireless signal transmitter is included in a module with the electrical signal filter and a battery.

11. The percussive beater of claim 1 wherein the padding layer is in mechanical communication with the front face of the beater head.

12. The percussive beater of claim 11 wherein the padding layer is made of a foam material.

13. The percussive beater of claim 11 wherein the padding layer includes expanded polyethylene.

14. The percussive beater of claim 1 wherein the transducer is located inside of the beater head.

15. The percussive beater of claim 1 wherein the transducer is included in a bore of the beater head.

16. The percussive beater of claim 1 wherein the second end of the percussive beater is configured to be coupled to a foot pedal apparatus for use with a kick drum.

17. A percussive beater comprising:

an elongated shaft having a first end and a second end;

a beater head mechanically coupled to the first end of the elongated shaft, the beater head including a front face located on and forming an exterior surface of the beater head, the exterior surface of the beater head for beating a drum;

a padding layer in mechanical communication with the transducer such that either (i) the padding layer is located between an interior surface of the front face and the transducer, or (ii) the transducer is located between the interior surface of the front face and the padding layer; and a transducer mechanically coupled to the beater head, the transducer configured to receive an impact from the beater head and convert the impact into an electrical signal, wherein the transducer and at least one of a wireless connector, an electrical connector or electrical wire are located inside the beater head.

18. The percussive beater of claim 17 wherein the padding layer includes expanded polyethylene.

19. A system for providing percussion sounds, the system comprising:

a percussive beater having:

an elongated shaft having a first end and a second end;

a beater head mechanically coupled to the first end of the elongated shaft, the beater head including a front face;

a transducer mechanically coupled to the beater head, the transducer configured to receive an impact from the beater head and convert the impact into an electrical signal; and an electrical signal filter in electronic communication with the transducer, the electrical signal filter configured to (i) receive the electrical signal, (ii) adjust a portion of the electrical signal, and (iii) output an adjusted electrical signal;

a trigger module in electronic communication with the percussive beater, the trigger module configured to process the adjusted electrical signal provided by the percussive beater and produce an output signal; and an audio playback device in electronic communication with the percussive beater, the audio playback device configured to play a predetermined sound upon receiving the output signal from the trigger module.

20. The system of claim 19 wherein the front face of the beater head is located on and forms an exterior surface of the beater head, the exterior surface of the beater head for beating a drum; and further including a padding layer in mechanical communication with the transducer such that either (i) the padding layer is located between an interior surface of the front face and the transducer, or (ii) the transducer is located between the interior surface of the front face and the padding layer.

21. A percussive beater comprising:

an elongated shaft having a first end and a second end;

a beater head mechanically coupled to the first end of the elongated shaft, the beater head including a front face;

a transducer mechanically coupled to the beater head, the transducer configured to receive an impact from the beater head and convert the impact into an electrical signal; and an electrical signal filter in electronic communication with the transducer, the electrical signal filter configured to (i) receive the electrical signal, (ii) adjust a portion of the electrical signal, and (iii) output an adjusted electrical signal, wherein the electrical signal filter removes a portion of the electrical signal outside of a certain frequency band, the frequency band between 800 MHz and 8.0 KHz.

* * * * *